US005224526A

United States Patent [19]

Mette et al.

[11] Patent Number: 5,224,526

[45] Date of Patent: Jul. 6, 1993

[54] APPARATUS FOR ADMITTING METERED QUANTITIES OF LIQUID INTO CONTAINERS

[75] Inventors: Manfred Mette, Hamburg; Wolfgang Fiwek, Wohltorf, both of Fed. Rep. of Germany

[73] Assignee: alfill Getränketechnik GmbH, Hamburg, Fed. Rep. of Germany

[21] Appl. No.: 733,102

[22] Filed: Jul. 19, 1991

[30] Foreign Application Priority Data

Jul. 28, 1990 [DE] Fed. Rep. of Germany ..... 4023998

[51] Int. Cl.[5] ..... B65B 1/04

[52] U.S. Cl. ..... 141/285; 141/236; 141/324; 222/318; 222/424

[58] Field of Search ..... 141/6, 39, 40, 48, 146, 141/147, 46, 47, 145, 148, 149, 150, 126, 127, 319–321, 285, 290, 324, 236; 222/424.5, 425, 426, 108–111, 318, 424

[56] References Cited

U.S. PATENT DOCUMENTS

| | | | |
|---|---|---|---|
| 2,144,628 | 1/1939 | Hothersall | 141/150 |
| 2,904,221 | 9/1959 | Carter | 141/147 |
| 3,097,672 | 7/1963 | Minard | 141/147 |
| 3,335,767 | 8/1967 | Manas | 141/147 |
| 3,374,811 | 3/1968 | Goosman | 222/109 |
| 3,760,853 | 9/1973 | Trusselle | 141/146 |
| 5,125,440 | 6/1992 | Mette | 141/39 |

FOREIGN PATENT DOCUMENTS 3025786 2/1982 Fed. Rep. of Germany .

*Primary Examiner*—Henry J. Recla
*Assistant Examiner*—Robert A. Goldman
*Attorney, Agent, or Firm*—Peter K. Kontler

[57] ABSTRACT

Bottles, cans or other types of containers are filled with accurately metered quantities of a liquid by employing a number of discrete filling units which orbit about a vertical axis and are provided with metering chambers receiving liquid from a main source of supply. The metering chambers are overfilled with liquid, and the excess is collected and returned to the main source. The filling units and certain other parts (such as an annular vessel of the main source) of the apparatus can be of modular design to facilitate storage and transport of modules which are assembled into a container filling apparatus at the filling plant. The method and apparatus can be utilized with advantage for the admission of metered quantities of carbonated and/or pulp-containing beverages into bottles or cans. The capacities of the metering chambers can be varied within a desired range, and each filling unit is provided with a first outlet which serves to admit metered quantities of liquid from the respective metering chamber into successive containers, and with a second outlet which is used to admit liquid from the vessel into the respective metering chamber.

24 Claims, 3 Drawing Sheets

APPARATUS FOR ADMITTING METERED QUANTITIES OF LIQUID INTO CONTAINERS

BACKGROUND OF THE INVENTION

The invention relates to improvements in methods of and in apparatus for admitting liquids into containers, and more particularly to improvements in methods of and in apparatus for admitting metered quantities of liquids (such as carbonated beverages) into bottles or cans. Still more particularly, the invention relates to improvements in methods of and in apparatus which can be utilized with advantage for admission of pressurized liquids into containers wherein the pressure exceeds atmospheric pressure.

It is known to provide a bottle filling apparatus with a plurality of filling units each of which can receive liquid from a vessel and each of which is equipped with a bottle centering and sealing device as well as with a sealable outlet which admits liquid into a properly centered bottle. The vessel contains a relatively large supply of liquid below a cushion of compressed gas, and the apparatus normally embodies a regulator which maintains the top surface of the supply of liquid at, or at least close to, a preselected level. This establishes satisfactory circumstances for admission of desired quantities of liquid into each of a shorter or longer series of successive containers. The vessel can resemble or constitute an annular tank which is driven to rotate about a vertical axis and receives liquid from a centrally located primary source. Thus, the annular tank can turn relative to and about the primary source, and all of the filling units share the angular movements of the tank. Each filling unit is equipped with means for receiving liquid from the tank, with means for dispensing liquid into a properly centered container, with a centering and sealing device as well as with other parts which are needed for controlled admission and dispensing of gaseous and/or hydraulic fluids. Apparatus of the above outlined character can be used for the filling of bottles, cans and/or other types of containers with all kinds of liquids including non-carbonated beverages (such as milk, fruit juices and plain water) as well as carbonated beverages (e.g., beer, club soda and various colas) which must be admitted into internally pressurized containers. The filling units of apparatus for admission of carbonated beverages are equipped with integrated conduits and valves for liquids as well as with integrated pipes and valves for gaseous fluids. An apparatus of the above described character is disclosed, for example, in published German patent application No. 30 25 786. If the apparatus is to be used for the filling of containers with non-pressurized beverages or other non-pressurized liquids, liquid is discharged from the filling units into properly centered empty containers by gravity flow in response to opening of valves which control the outflow of liquid from filling units. If the apparatus is to dispense a pressurized liquid, the filling units admit compressed gas into the properly centered and sealed containers below them so that the pressure in the containers matches the pressure in the tank. The liquid is then permitted to flow into the containers to thereby expel the gases from the containers. As a rule, the expelled gases are caused to flow into the space above the supply of liquid in the tank. To this end, each filling unit is equipped with a gas evacuating pipe having a lower end extending into the upper portion of a properly centered container. The level of the lower end of the gas evacuating pipe determines the upper level of the body of liquid which can be admitted into a container. However, since the capacity of bottles and certain other containers is not constant, i.e., it does not match a preselected value, the aforedescribed mode of selecting the quantity of liquid in filled bottles or other containers does not ensure that each of a short or long series of filled containers invariably stores a predetermined quantity of liquid.

Another drawback of the aforedescribed mode of filling containers to the level of the lower ends of gas evacuating pipes is that the rising body of liquid in a bottle which is in the process of receiving liquid is likely to wet the lower ends of the pipes. Such liquid is atomized during admission of gas into the next bottle and is likely to cause foaming which is undesirable in many or most instances.

OBJECTS OF THE INVENTION

An object of the invention is to provide a novel and improved method which renders it possible to admit accurately determined quantities of liquids into each of a number of successively or simultaneously filled containers.

Another object of the invention is to provide an economical container filling method which renders it possible to dispense a liquid only into containers and to avoid spillage and/or over filling.

A further object of the invention is to provide a method which renders it possible to admit accurately metered quantities of carbonated or non-carbonated liquids into containers having identical or different capacities.

An additional object of the invention is to provide a method which renders it possible to recover any and all excess of liquid which is admitted from a main source of supply into discrete container filling units.

Still another object of the invention is to provide a method which renders it possible to reduce the rate of flow or interrupt the flow of liquid from the main source to a filling unit when the filling of a container is completed.

Another object of the invention is to provide a novel and improved apparatus for the practice of the above outlined method.

A further object of the invention is to provide novel and improved container filling units for use in the above outlined apparatus.

An additional object of the invention is to provide a novel and improved main source of liquid supply for use in the above outlined apparatus.

A further object of the invention is to provide the apparatus with novel and improved means for recirculating liquid from the container filling units to the main source of supply.

An additional object of the invention is to provide an apparatus which can be rapidly assembled or taken apart and wherein discrete filling units and/or other constituents can be inspected, repaired or replaced without necessitating even partial dismantling of unaffected portions of the apparatus.

Another object of the invention is to provide the apparatus with novel and improved means for regulating the admission of liquid into and the evacuation of liquid from discrete container filling units.

A further object of the invention is to provide a method and an apparatus which can be used for admission of liquids into bottles or other containers without foaming.

SUMMARY OF THE INVENTION

One feature of the present invention resides in the provision of a method of admitting liquid into containers, particularly of admitting a pressurized carbonated beverage into bottles or cans. The improved method comprises the steps of establishing and maintaining a main source of supply of liquid, conveying liquid from the main source into at least one metering chamber having a predetermined (preferably variable) capacity, and transferring metered quantities of liquid from the at least one metering chamber into containers.

The conveying step can comprise conveying from the main source liquid in excess of the quantity which is needed to fill the at least one metering chamber to capacity, and separating the excess from the liquid which fills the at least one metering chamber to capacity. Such method preferably further comprises the steps of collecting the separated excess and returning the separated and collected excess to the main source.

The collected excess can be monitored, and at least some liquid can be separated from the collected excess (particularly for returning the thus separated liquid to the main source) when the monitored quantity of collected excess reaches a preselected value.

The method can further comprise the steps of raising the pressure in the containers prior to the respective transferring steps, and pressurizing the metered quantities of liquid in the course of the transferring steps.

The conveying step can include conveying the liquid from the main source into the at least one metering chamber by gravity flow. This can involve maintaining the upper surface of liquid in the main source above a predetermined level and positioning the at least one metering chamber beneath such level.

The method can further comprise the steps of moving the containers relative to the at least one metering chamber upon completed transfer of metered quantities of liquid into the containers, and at least reducing the rate of conveying liquid from the main source into the at least one metering chamber in response to each moving step.

Another feature of the invention resides in the provision of an apparatus for admitting a liquid into containers, particularly for admitting a pressurized beverage into bottles or cans. The improved apparatus comprises a main source of supply of liquid, and container filling means including at least one filling unit. The at least one filling unit includes means for centering discrete containers for reception of liquid, a first sealable and openable outlet for admission of liquid into a centered container, and a metering chamber for reception of metered quantity of liquid from the main source through a second sealable and openable outlet and for transfer of metered quantity of liquid into a centered container through the first outlet.

The apparatus preferably further comprises means for supplying from the main source through the second inlet liquid in excess of that which is required to fill the metering chamber to capacity. The at least one filling unit then preferably further comprises means for collecting the excess. The metering chamber of such filling unit preferably comprises a portion from which the excess overflows.

Still further, the at least one filling unit can comprise a housing having a closed upper end and a lower end provided with the first outlet and with the combined centering and sealing means. The aforementioned portion of the metering chamber can include an upright receptacle in the form of a duct which is spacedly surrounded by the housing and receives liquid from the main source through the second outlet. The duct and the housing of the at least one filling unit preferably define a compartment for collection of excess liquid, and such filling unit further comprises means for evacuating excess liquid from the compartment. Such excess is preferably returned to the main source. The means for returning excess liquid to the main source includes the compartment between the housing and the duct of the at least one filling unit (such compartment can be said to constitute a means for collecting the excess in the at least one filling unit), and the returning means preferably further includes means for monitoring the collected excess, a pump which is operable to deliver collected excess from the collecting means, and control means for operating the pump when the quantity of monitored excess reaches a predetermined value.

The container filling means can include a plurality of discrete filling units, and each such unit is provided with means for collecting the excess. A common conduit can be provided for reception of excess from the collecting means of two or more filling units, and such apparatus further comprises means for delivering excess from the common conduit to the main source of supply.

The supply of liquid in the main source can be maintained above a predetermined level, and the metering chamber of each filling unit can be located below such level.

Each filling unit can comprise a gas-containing upper portion or section which is located above the respective metering chamber and wherein a gas is maintained at a first pressure, and the main source then includes an upper part wherein the gas is maintained at a second pressure which at least approximates the first pressure.

The apparatus can further comprise means for regulating the capacity of each metering chamber. To this end, each metering chamber can have an open top adjacent the gas-containing upper portion of the respective filling unit. The regulating means can include a displacing member (e.g., in the form of an elongated plunger) which is disposed in the upper portion of each filling unit and is movable up and down through the open top of the respective metering chamber.

Still further, the apparatus can be provided with means for at least reducing the rate of liquid flow through the second outlet of each filling unit and into the respective metering chamber once the metering chamber is filled to capacity.

The main source can include a rotary vessel and a distributor which is surrounded by the vessel and has at least one conduit which delivers liquid to the vessel. The filling unit or units are rotatable with the vessel and their metering chambers receive liquid from the vessel. The vessel can be assembled from arcuate sections of a plurality of modules each of which is rotatable with at least two filling units and each of which comprises means for receiving liquid from the distributor and means for supplying liquid to the metering chambers of the respective filling units. Each module can further comprise a source of gaseous fluid and pipes connecting the source of gaseous fluid with the respective filling units. The means for supplying liquid from a module to the respective filling units comprises conduits which supply liquid to the metering chambers of the respective units in excess of that which is required to fill the metering chambers to capacity, and such apparatus preferably further comprises means for collecting the excess. The collecting means can comprise an annular conduit having a plurality of arcuate sections each of which is connected with and receives excess liquid from at least two filling units. Each arcuate section of the collecting conduit can be integrated into one of the modules, and each such arcuate section can have two closed ends. The arcuate sections of the collecting conduit can constitute pieces of tubing.

The apparatus can comprises a common driven rotor for the modules. Each such module can have two closed ends and can include at least one piece of tubing.

The distributor of the main source of supply can include a liquid-containing stationary lower portion and a rotary upper portion which is connected with the annular vessel of the main source. Such apparatus can further comprise a preferably stationary source of gas, a pipe which is connected to the source of gas and extends through the lower portion of the distributor to admit gas into the upper portion of the distributor, and at least one gas pipe which connects the upper portion of the distributor with the annular vessel to maintain in the vessel a supply of gas above a body of liquid.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
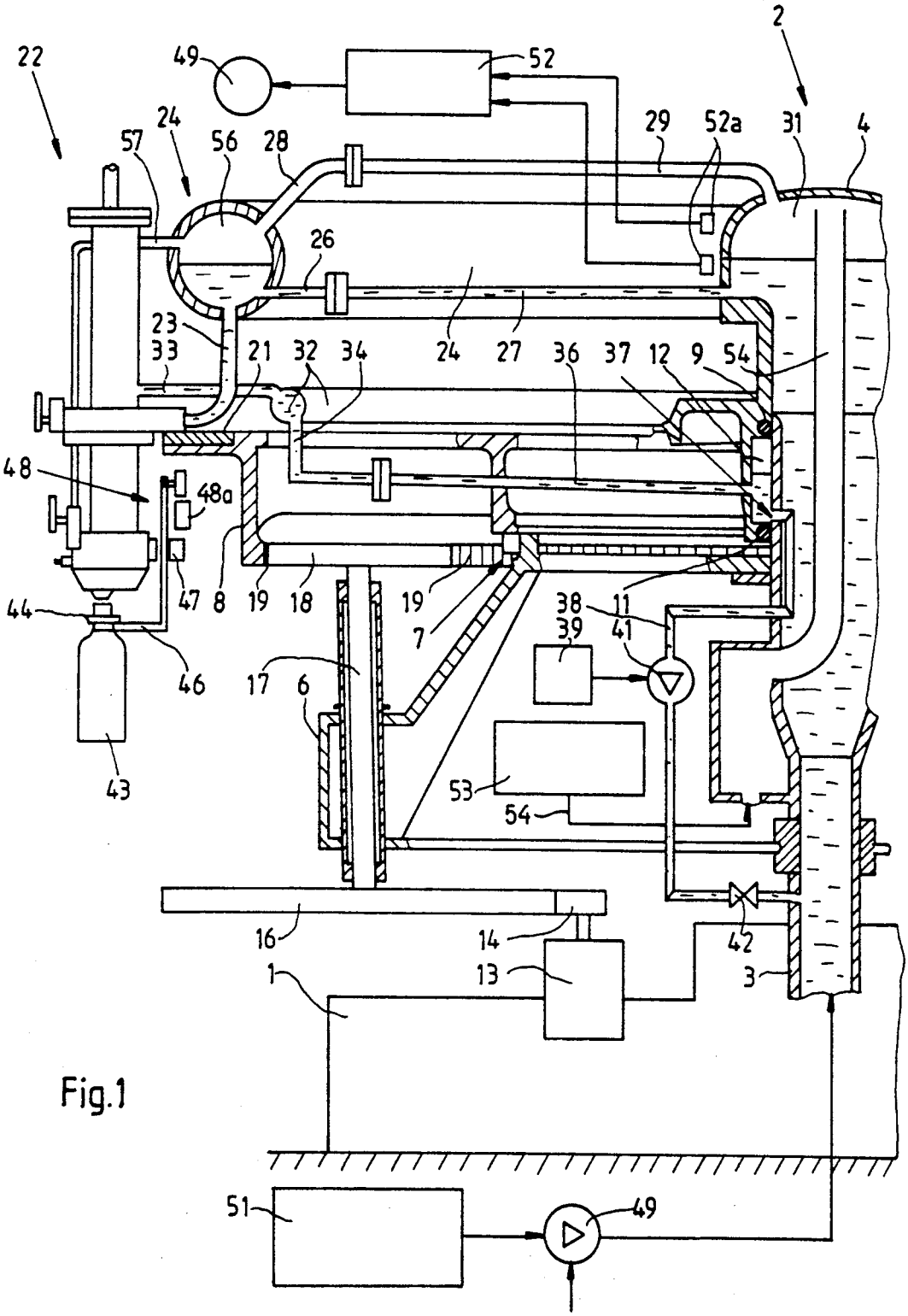
FIG. 1 is a fragmentary partly schematic central sectional view of an apparatus which embodies one form of the invention and is designed to fill bottles with carbonated beverages.

FIG. 1 is a fragmentary partly diagrammatic sectional view of a filling apparatus which embodies one form of the present invention. Only approximately one half of the apparatus is shown because the other half is a mirror image of the illustrated structure with the exception of drive means which is shown in FIG. 1 and has no counterpart in the non-illustrated half of the apparatus.

The improved apparatus comprises a base 1 which supports and is connected with a central distributor 2 for liquid which is admitted into container filling units 22 (only one shown in FIG. 1). The distributor 2 comprises a stationary lower portion 3 and a rotary upper portion or head 4. The lower portion 3 carries a stationary frame 6 which, in turn, carries a bearing assembly 7 for the rotor 8 of container filling means including the filling units. The rotor 8 is rigidly connected with the upper portion 4 of the distributor 2, i.e., the upper portion 4 shares all angular movements of the rotor. Sealing elements 9 and 11 are provided between the portions 3, 4 of the distributor 2 to seal the interior of the distributor from the surrounding atmosphere and from an annular chamber 12 the purpose of which will be explained in full detail hereinafter. The means for driving the rotor 8 for the filling units 22 comprises a motor 13 (e.g., a variable-speed electric motor) and a gear transmission including a pinion 14 on the output element of the motor 13, a relatively large gear 16 at the lower end of a shaft 17, a further gear 18 at the upper end of the shaft 17 and an internal gear 19 provided on the rotor 8 and mating with the gear 18. The shaft 17 is rotatably journalled in the frame 6. The illustrated drive means exhibits the advantage that it is simple, compact and inexpensive.

Figure 2:
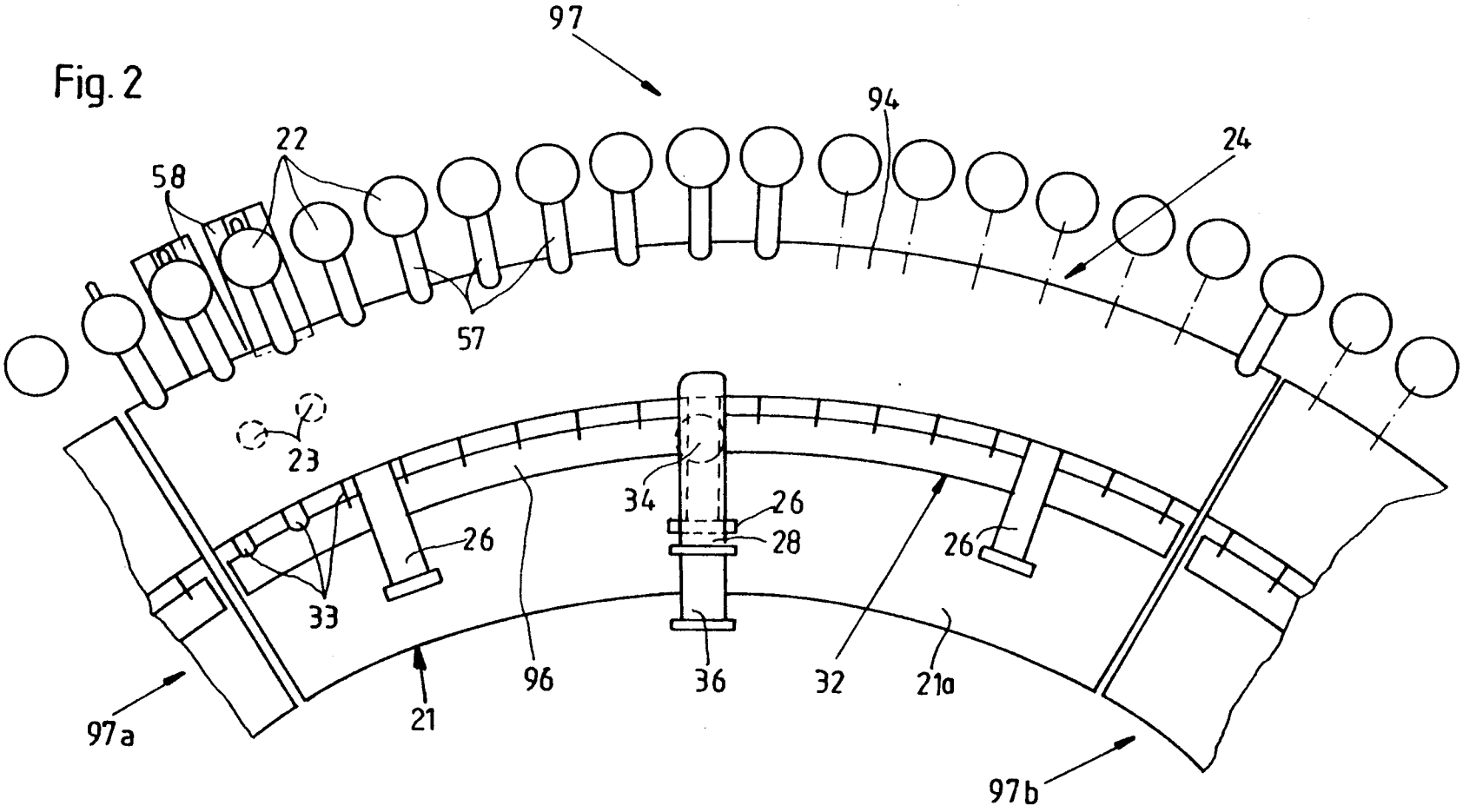
FIG. 2 is a fragmentary plan view of the apparatus.

Several of the filling units 22 which are carried by the rotor 8 are shown in FIG. 2. These filling units are actually mounted on a washer-like holder 21 which is recessed into the upper side of the rotor 8 and can be said to constitute an integral part of the latter. Conduits 23 are provided to receive liquid from and to carry an annular vessel or tank 24 at a level above the rotor 8. The vessel 24 is provided with nipples 26 which connect it to conduits 27 leading to the upper portion 4 of the distributor 2. The upper part 31 of the internal space of the distributor portion 4 is filled with a gas and is connected with pipes 29 serving to supply gas to the upper part 56 of the internal space of the vessel 24 by way of nipples 28. The illustrated nipples 26 and 28 constitute but one form of means for preferably separably but fluidtightly connecting the annular vessel 24 with the liquid supplying conduits 27 and with the gas-supplying pipes 29, respectively. The distributor 2 and the annular vessel or tank 24 constitute the main source of supply of liquid.

The rotor 8 for the filling units 22 further carries an annular collecting conduit 32 which is connected with the filling units 22 by excess liquid evacuating nipples 33 and with one or more return conduits 36 by nipples 34. The return conduits 36 supply liquid to the upper part of the liquid-containing stationary lower portion 3 of the distributor 2.

The annular chamber 12 is connected to the body of liquid in the distributor 2 by a conduit 38. The conduit 38 contains a pump 41 the operation of which is controlled by a control unit 39. A check valve or one-way valve 42 is provided to prevent the flow of liquid from the distributor 2 into the annular chamber 12.

FIG. 1 shows a container 43 in the form of a bottle, e.g., a bottle which is made of a plastic material such as polyethylene. The illustrated bottle 43 has an external collar 44 which surrounds its neck and is supported by a gripper 46. This gripper permits vertical movements of the bottle 43 relative to the respective filling unit 22 in that it is movable with the properly engaged bottle up and down under the action of a cam-operated elevator 48. The cam is shown at **48*a* and a support which pivotally mounts the gripper 46 is shown at 47**.

Liquid which is to be admitted into the bottles 43 is drawn from a primary source 51 by a pump 49 (shown twice in FIG. 1) which is controlled by a control unit 52 having inputs connected to the outputs of two level monitoring devices **52*a* adjacent the level of the top surface of the body of liquid in the distributor 2. Thus, the pump 49 is operated in response to signals which are indicative of the level of the supply of liquid in the distributor 2 so that such level fluctuates little or not at all. The establishment and maintenance of a substantially constant supply of liquid in the distributor 2 is desirable and advantageous because this contributes to more predictable filling of discrete bottles 43 with accurately metered quantities of liquid, e.g., a beverage. The conduits 27 convey liquid from the distributor 2 into the annular vessel 24 wherein the level of the upper surface of the body of liquid coincides or practically coincides with the level of the top surface of the body of liquid in the upper portion 4 of the distributor 2**.

If the liquid to be admitted into bottles 43 is a carbonated beverage which is to be admitted at elevated pressure, the admission of liquid into successive bottles 43 takes place while the interior of a bottle to be filled is maintained at an elevated counterpressure. The gas which establishes such counterpressure is stored in a source 53 (e.g., a tank) and is admitted into the upper part 31 of the internal space of upper portion 4 of the distributor 2 by a stationary pipe 54. An intermediate portion of the pipe 54 is connected with the stationary lower part 3 of the distributor 2, and the top portion of the pipe 54 is confined in the distributor 2 and its open upper end discharges gas into the upper part 31 of the internal space of the upper portion 4. The pressure in the source 53 is preferably adjustable so that it is possible to select the pressure of gas in the upper part 31 of the internal space of the upper portion 4. The pipes 29 and nipples 28 convey compressed gas from the upper part 31 into the upper part 56 of the internal space of the annular vessel 24. Pipes 57 serve to admit gas from the upper part 56 of the internal space of the vessel 24 into the respective filing units 22.

The annular vessel 24, the collecting conduit 32 as well as all of the aforementioned conduits, nipples and pipes are preferably pieces of tubing. This renders it possible to assemble the improved apparatus by resorting to modules which together form a lightweight but highly stable structure with readily accessible and readily separable and reattachable components.

Figure 3:
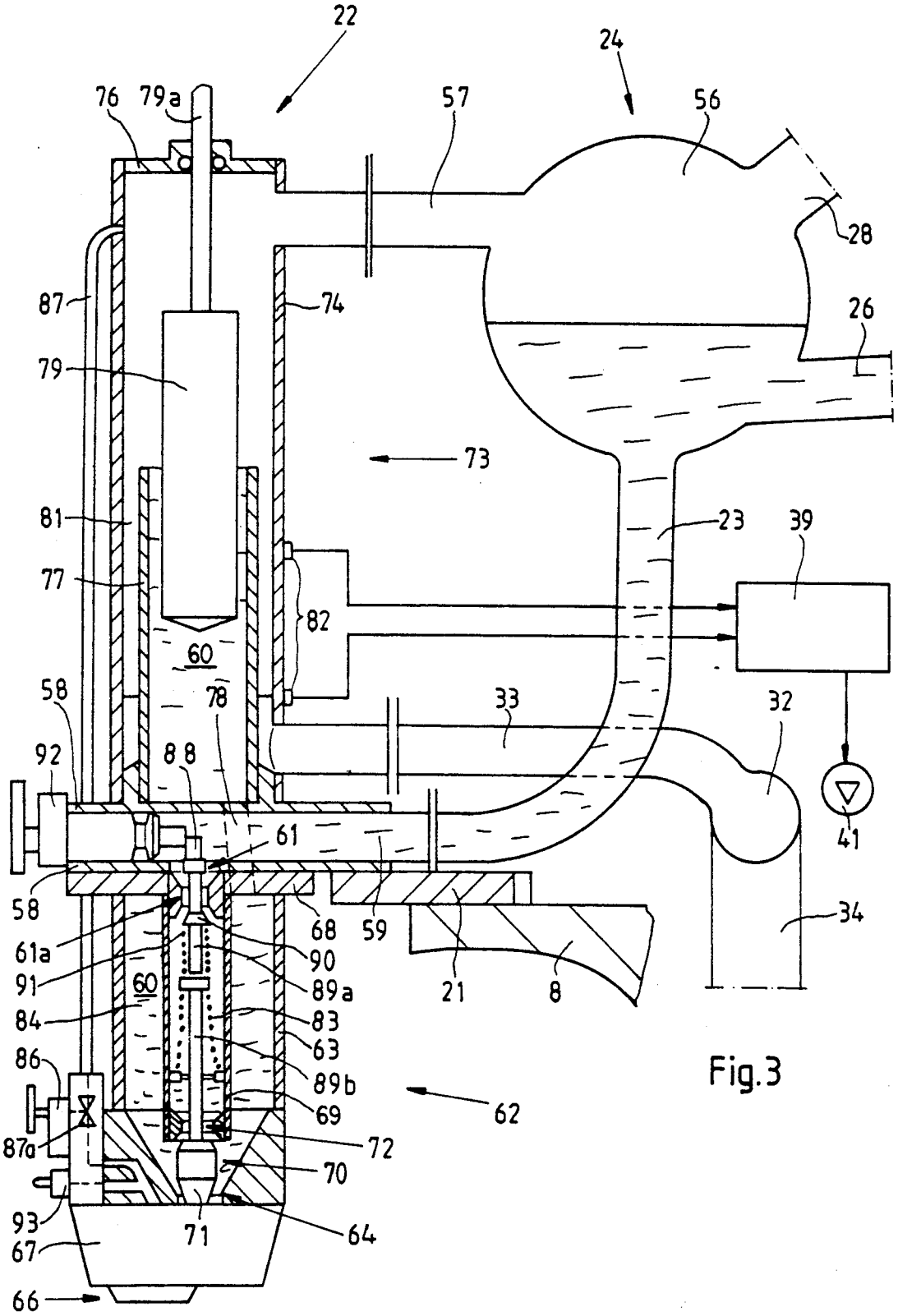
FIG. 3 is an enlarged view of a detail in the apparatus of FIG. 1, showing the construction of one of a set of filling units.

The details of one presently preferred embodiment of a filling unit 22 are illustrated in FIG. 3. All such parts of this filling unit, and the components which lead to and from it and are also shown in FIGS. 1 and 2, are denoted by similar reference characters.

The filling unit 22 of FIG. 3 comprises a support 58 which is affixed to the washer-like holder 21 on the rotor 8. The upper side and the underside of the support 58 carry numerous constituents of the filling unit 22, i.e., such unit extends in part above and in part below the respective support 58 and the adjacent portion of the holder 21. The support 58 embodies or surrounds the discharge end of a conduit 59 which is connected with the annular vessel 24 by one of the conduits 23. The outlet of the conduit 59 communicates with an opening 61 in the underside of the support 58.

The filling unit 22 of FIG. 3 comprises a lower section 62 having an upright cylindrical casing or housing 63, an openable and sealable outlet 64 for admission of metered quantities of liquid into successive bottles 43, and a combined centering and sealing device 66 for bottles 43. The details of a suitable combined centering and sealing device which can be used in the filling unit 22 of FIG. 2 are described and shown, for example, in commonly owned copending patent application Ser. No. 07/568,273 filed Aug. 15, 1990, now U.S. Pat. No. 5,125,440 by Manfred Mette for "Apparatus for filling bottles and the like". The illustrated lower section 62 further comprises a so-called swirling chamber 67 which is designed to impart to the outflowing metered quantity of liquid a swirling or circulating motion. A suitable swirling chamber is described and shown in commonly owned copending patent application Ser. No. 07/687,453 filed Apr. 18, 1991, now U.S. Pat. No. 5,125,441 by Manfred Mette for "Apparatus for filling bottles with a liquid" and corresponding to the German priority application No. P 40 12 849.0 filed Apr. 23, 1990. The lower section 62 preferably constitutes a self-contained prefabricated assembly or component which is closed from above by a cover 68 and is separably or permanently secured to the support 58. A central opening **61*a* of the lower section 61 registers with the aforementioned opening 61 in the underside of the support 58 when the lower section 62 is properly bottled, screwed, riveted or otherwise affixed to the support 58**.

An elongated upright tubular extension 69 in the section 62 surrounds the opening **61*a* in the substantially plate-like cover 68 and can be said to constitute a downward extension of the conduit 59 all the way to a level somewhat above the outlet 64 at the combined centering and sealing device 66. The lower end portion of the extension 69 contains the upper seat for a valving element 71 forming part of a twin-seated valve 70. The upper seat of the valve 70 surrounds an openable and sealable outlet 72 which, when exposed, permits liquid to flow from the extension 69 into a metering chamber 60 between the extension 69 and the cylindrical casing or housing 63 of the lower section 62 of the filling unit 22. When in the upper end position, the valving element 71 of the valve 70 seals the outlet 72, i.e., the conduit 59 is then sealed from the metering chamber 60. When in the lower end position, the valving element 71 permits liquid to flow from the extension 69 (i.e., from the conduit 59) into the metering chamber 60 but seals the outlet 64 to thus prevent liquid from flowing from the chamber 60 into the bottle 43 which is engaged and centered by the device 66**.

An upper section 73 of the filling unit 22 is located at the upper side of the support 58. The upper section 73 comprises a cylindrical casing or housing 74 having an upper end which is gas-tightly closed by a cover or lid 76. The interior of the housing 74 accommodates an overflow receptacle 77 in the form of an upright tube or duct having an open upper end and being permanently connected with the interior of the lower section 62 by one or more passages or channels 78 which are provided in the support 58. This enables the overflow receptacle 77 to constitute an upward extension of the metering chamber 60. The metering chamber 60 contains a predetermined (metered) quantity of liquid when it is filled all the way to the open upper end of the duct 77.

A displacing or volume regulating member 79 in the form of an elongated plunger dips from above into the overflow duct 77 and can be raised or lowered to select the capacity of the metering chamber 60. An adjusting rod **79*a* for the displacing member 79 extends upwardly through the cover 76 and can be manipulated by hand with reference to a suitable scale, not shown. The member 79 can extend into the overflow duct 77 with considerable play and need not be guided and/or otherwise confined to movements along an accurately determined path. The only seal which must be provided is that shown around the adjusting rod 79*a* in the cover 76. Such mounting of the member 79 contributes to simplicity and ease of cleaning of the filling unit 22**.

An annular liquid collecting compartment 81 between the duct 77 and the housing or casing 74 gathers excess or surplus liquid which overflows the upper edge face of the duct 77. The contents of the compartment 81 are returned into the collecting conduit 32 through the respective nipple 33. The control unit 39 for the pump 41 receives signals from two sensors 82 which monitor the level of the supply of excess liquid in the compartment 81, e.g., to ensure that the pump 41 begins to draw liquid into the conduit 38 when the upper sensor 82 is submerged in excess liquid and that the pump 41 is arrested when the lower sensor 82 is above the supply of excess liquid in the compartment 81.

The entire metering chamber 60 of each filling unit 22 is located below the level of the top surface of liquid in the annular vessel 24, i.e., the upper edge face of the overflow duct 77 is invariably below the upper part 56 of the vessel 24. Thus, each metering chamber 60 can be filled exclusively by gravity flow which entails savings in liquid conveying means. However, and if necessary due to space considerations and/or for other reasons, the metering chamber 60 of each filling unit 22 can extend at least slightly above the upper surface of the supply of liquid in the vessel 24; the apparatus then comprises one or more pumps (not shown) which ensure that each metering chamber 60 is filled with liquid before the respective valving element 71 exposes the corresponding outlet 72 in order to permit admission of a metered quantity of liquid into a bottle 43. An advantage of placing at least a portion of each metering chamber 60 above the top surface of liquid in the vessel 72 is that excess liquid can be returned to the main liquid source by gravity flow. The illustrated embodiment (with each metering chamber 60 adapted to be filled with liquid by gravity flow) is preferred at this time because the required pump capacity can be reduced and liquid is prevented from leaving a freshly filled metering chamber 60 except in response to exposure of the corresponding outlet 72, i.e., only for the purpose of admitting the metered quantity of liquid into a bottle 43.

A twin-seated valve which can be used in the filling units 22 is described and shown in the commonly owned copending patent application Ser. No. 07/675,428 filed Mar. 26, 1991 now U.S. Pat. No. 5,150,743 by Jacek Walusiak for "Apparatus for admitting metered quantities of liquid into bottles or other containers".

When the improved apparatus is in actual use, the valving element 71 of each twin-seated valve 70 is maintained in the lower end position to seal the respective first outlet 64 as long as the corresponding centering device 66 does not properly engage and seal the inlet at the upper end of the neck of a bottle 43 and as long as a properly centered and sealed bottle 43 is not pressurized so that the pressure therein matches the pressure in the upper section 73 of the respective filling unit 22. The pressure of liquid in the extension 69 of each filling unit 22, plus the pressure of gas in the upper portion of such filling unit ensure that the valving element 71 is maintained in the lower end position (to seal the respective outlet 64) against the opposition of a coil spring 83 which reacts against an internal shoulder of the extension 69 and bears against a collar at the upper end of a motion transmitting rod **89*b* for the valving element 71. Thus, liquid is free to flow from the lower portion of the annular vessel 24, through the conduits 23 and 59, through the openings 61 and 61*a*, through the conduits 23 and 59, through the openings 61 and 61*a*, through the extension 69 and outlet 72 (which is then open) and into the metering chamber 60. The liquid first fills the lower portion 84 of the metering chamber 60 and thereupon rises into the passage or passages 78 and into the duct 77 (i.e., into the upper portion of the metering chamber 60) to ultimately overflow into the annular collecting compartment 81 which receives and collects the excess. The excess leaves the compartment 81 through the excess liquid evacuating conduit 33 and excess liquid collecting conduit 32 which communicates with the annular chamber 12 by way of the nipple 35 and return conduit 36. The sensors 82 of the excess liquid level monitoring means at the cylindrical housing or casing 74 of the upper portion 73 of the filling unit 22 ensure the liquid level in the compartment 81 cannot rise above the upper edge face of the duct 77. For example, the upper sensor 82 can start the pump 41 through the control unit 39 when it is immersed in excess liquid in the compartment 81, and the lower sensor 82 can arrest the pump 41 through the medium of the control unit 39 when it is not immersed in the body of excess liquid in the compartment 81. As already described above, the pump 41 serves to convey liquid from the annular chamber 12 into the lower portion 3 of the distributor 2. An advantage of the chamber 12 (which can rotate relative to but communicates (at 37) with the conduit 38 for the pump 41 is that a single pump (41) suffices to return the collected excess from the compartments 81 of two, three or all filling units 22 into the lower portion 3 of the distributor 2**.

When a bottle 43 is properly centered and sealed by the combined centering and sealing device 66 of a filling unit 22, a cam-operated actuator 86 (FIG. 3) opens a valve **87*a* in a pipe 87 which serves to admit compressed gas from the upper section or portion 73 of the respective filling unit 22 into the centered bottle 43. Thus, the pressure in the bottle 43 then matches the pressure in the upper section 73 and hence the pressure in the gas-filled upper part 56 of the annular vessel 24. When the pressure in the bottle 43 actually matches the pressure in the upper section 73 of the respective filling unit 22, the pressure above the valving element 71 of such filling unit matches the pressure below the valving element; therefore, the spring 83 is free to dissipate energy and to lift the valving element 71 out of the outlet 64 and into the outlet 72. Thus, the metering chamber 60 is sealed from the annular vessel 24 but is free to admit an accurately metered quantity of liquid into the bottle 43 which is engaged by the respective centering and sealing device 66**.

When the bottle 43 is filled (i.e., when such bottle has received and confines an accurately metered quantity of liquid), a stationary cam which is adjacent the path of movement of filling units 22 with the rotor 8 engages an actuator 92 which, in turn, actuates an eccentric follower 88 at the upper end of a rod **89*a* which is coaxial with the motion transmitting rod 89*b*. A coil spring 91 which reacts against a valving element 90 on the rod 89*a* then bears against the collar at the upper end of the rod 89*a* and returns the valving element 71 to the lower end position (outlet 64 sealed and outlet 72 open) against the opposition of the coil spring 83. Thus, the metering chamber 60 is free to receive a liquid via conduits 23, 59 and outlet 72**.

The improved apparatus further comprises means for at least reducing the rate of flow of liquid into a metering chamber 60 once the metering chamber is filled to capacity. Thus, the apparatus can limit the quantity of excess liquid which overflows the duct 77 and enters the annular compartment 81 of a filling unit 22 when the respective metering chamber 60 is already filled. The excess reducing means comprises the aforementioned valving element 90 which is mounted on or forms part of the rod 89*a* and enters the opening 61*a* from below when the spring 91 is free to dissipate energy to thereby lift the rod 89*a*, e.g., while simultaneously moving the rod 89*b* downwardly. To this end, the follower 88 is actuated again by a cam which is adjacent the path of movement of the actuator 92 for the follower 88, and the thus actuated follower 88 enables the spring 91 to expand to a desired extent, namely to enable the valving element 90 to partially or completely seal the lower opening 61*a* when it is absolutely certain that the respective metering chamber 60 is already filled to capacity, i.e., that liquid in such metering chamber fills the entire duct 77. The arrangement may be such that the actuator 92 receives motion from a first stationary cam in order to move the valving element 71 back to the lower end position of FIG. 3 as soon as a freshly filled bottle 43 is ready to move relative to the respective combined sealing and centering device 66, and that the actuator 92 is operated by a second stationary cam as soon as the filling of the bottle 43 with a metered quantity of liquid is completed.

Once the valving element 71 has been returned to the lower end position of FIG. 3, it remains in such position under the combined pressure of liquid and gas in the respective filling unit 22. The cycle is then repeated as soon as an empty bottle 43 has been engaged by the combined centering and sealing device 66.

An advantage of the valving element 90 is that the quantity of excess liquid which must be recirculated from the collecting compartments 81 into the distributor 2 is relatively small so that, as a rule, a single pump 41 suffices to return the collected excess into the lower portion 3 of the distributor 2. In fact, it is possible to employ a relatively small pump 41, even if the rotor 8 supports a large number of filling units 22.

The eccentric follower 88 and the actuator 92 are installed in the support 58 of the filling unit 22 which is shown in FIG. 3. The follower 88 is adjacent the discharge end of the conduit 59 at the opening 61 of the support 58.

The valve 87*a* in the pipe 87 of each filling unit 22 remains open during evacuation of a metered quantity of liquid from the respective chamber 60. Thus, the descending liquid can expel the gas from the properly centered bottle 43 into the upper portion or section 73 of the filling unit 22. The valve 87*a* is closed, or is permitted to close in a fully automatic way, when the transfer of a metered quantity of liquid into a bottle 43 is completed.

The reference character 93 denotes in FIG. 3 a relief valve which opens when the valve 87*a* is closed to reduce the pressure in the freshly filled bottle 43 so that the bottle is ready to be separated from the respective combined centering and sealing device 66.

An advantage of filling units 22 of the type shown in FIG. 3 is their compactness and simplicity. Actually, the major part of each such filling unit is assembled of a number of properly dimensioned interfitted tubular components. This renders it possible to keep the weight of filling units 22 to a minimum which is important if the rotor 8 is to carry a large number of filling units.

FIG. 2 shows that at least some components of the improved apparatus can constitute prefabricated modules which can be assembled or taken apart in a simple and time-saving manner. The washer-like holder 21 is assembled of several arcuate sections or portions 21*a*, and each such arcuate section 21*a* can carry a discrete arcuate tubular section or portion 94 of the annular vessel 24. Each section 94 is closed and sealed at both ends. Each arcuate section 21*a* further carries an arcuate tubular section or portion 96 of the annular collecting conduit 32, and each section or portion 96 has two closed and sealed ends. Still further, each arcuate section 21*a* carries two or more filling units 22 each of which is properly connected with the corresponding sections 94, 96 so that it can receive and discharge gaseous and hydraulic fluids.

The sections 21*a* of the holder 21, the respective sections 94, 96 and the respective sets of filling unit 22 constitute discrete preassembled modules which are placed next to each other and are assembled into the corresponding components of the aforedescribed container filling apparatus.

FIG. 2 merely shows a portion of an apparatus, namely a complete module 97 and portions of two neighboring modules 97*a*, 97*b*. The sections 21*a* of the holder 21 are affixed to the rotor 8 (not shown in FIG. 2) which is driven in a manner as described with reference to FIG. 1.

The feature that the apparatus is assembled of prefabricated modules 97, 97*a*, 97*b*, etc. contributes significantly to a reduction of the initial, assembly and maintenance cost of the apparatus, especially if the apparatus is a large structure employing a substantial number of filling units 22 or analogous filling units. Each module is provided with nipples or other connectors for reception and/or evacuation of gaseous and hydraulic fluids. However, it is equally within the purview of the invention to establish connections for the flow of gaseous and/or hydraulic fluids between two or more neighboring modules and to connect only one module, or a limited number of modules, to the distributor 2 or to another part which can supply and receive gaseous and hydraulic fluids.

The manner in which empty bottles 43 or other types of containers are removed to positions of register with the combined centering and sealing devices 66 of filling units 22, and in which filled containers are moved away from the respective filling units (e.g., to a capping station if the capping mechanisms are not incorporated in the filling units) forms no part of the present invention. Reference may be had to the commonly owned copending patent application Ser. No. 7/568,257 filed Aug. 15, 1990 by Wolfgang Fiwek et al. for "Method of and apparatus for filling and capping containers for beverages and the like". The same holds true for the construction and mode of operation of means for synchronizing various operations which take place while the rotor 8 is driven by the motor 13. Such operations include delivery of empty containers, proper orientation of delivered empty containers relative to the corresponding filling units 22, the filling of metering chambers with liquid, pressurizing (if necessary) of the containers prior to admission of metered quantities of liquid, automatic reduction of admission of excess liquid into the metering chambers, removal of filled containers from the respective filling units and transfer of freshly filled containers to the next processing station or stations.

An important advantage of the improved method and apparatus is that the quantity of liquid which is admitted into each of a short or long series of containers 43 is always the same, irrespective of the level to which the containers are filled with liquid. This is due to the fact that each filling unit 22 comprises a metering chamber 60 which is filled at least to capacity, i.e., preferably in such a way that some excess gathers in the respective collecting compartment 81. This ensures that each metering chamber 60 invariably contains a predetermined quantity of liquid which is thereupon admitted into a properly centered and sealed container 43 so that the container must confine a predetermined quantity of liquid rather than being filled to a predetermined level as proposed in the aforediscussed published German patent application No. 30 25 786.

Another important advantage of the improved method and apparatus is that the discharge ends of the gas pipes 87 need not extend into the inlets of containers 43, i.e., the discharge ends of such gas pipes do not and need not come into contact with the liquid in the containers. Therefore, renewed opening of the valves 87*a* does not entail an atomizing of liquid droplets which would have accumulated at the discharge ends of the pipes 87 if these pipes were to dip into the liquid in adjacent containers. Consequently, foaming of liquid in the containers is minimized or eliminated in its entirety. Otherwise stated, raising of pressure in freshly supplied containers 43 which are engaged by the centering and sealing devices 66 takes place in the absence of any liquid which is a highly efficient way of preventing foaming of carbonated beverages.

A further important advantage of the improved method and apparatus is that the quantity of liquid which is admitted into each container is independent of the exact volume or capacity of the containers as well as (at least to a considerable extent) of eventual fluctuations of the upper level of the body of liquid in the vessel 24. This, too, is attributable to the feature that each metering chamber 60 is filled to capacity before the respective outlet 64 is caused to permit a metered quantity of liquid to descend into the adjacent container 43.

Additional novel features of the improved method and apparatus include the raising of pressure in the containers for reception of carbonated beverages so that the raised pressure matches the pressure above the respective metering chamber and the descending liquid can expel the gas from the container which is in the process of receiving a metered quantity of liquid; the gathering of excess liquid, monitoring of the gathered excess, and returning of the gathered excess to the main source when the quantity of gathered excess reaches a preselected value (as determined by the sensor means 82); the admission of metered quantities of liquid into containers by gravity flow, even if the internal spaces of the containers are maintained above atmospheric pressure; and in interruption or reduction of admission of liquid into the metering chambers 60 as soon as or shortly after the metering chambers are filled to capacity.

Additional novel features of the improved apparatus reside in the aforedescribed construction and mode of operation and mounting of the filling units 22. Thus, the majority of components of each filling unit 22 can be assembled of pieces of piping or tubing having different or identical diameters and cooperating to form a metering chamber 60, an excess collecting compartment 81, a gas-filled portion above the duct 77, pipes (57, 87) which convey gas into and from the upper portion of upper section 73 of the filling unit, and conduits (59, 33) which serve to deliver liquid to and to convey excess liquid from the respective filling units. The utilization of a large number of tubular components contributes to simplicity, lower cost and considerable reduction of the weight of the filling units. The utilization of a single collecting conduit 32 for excess liquid which is evacuated from filling units 32 by the respective conduits 33 also contributes to simplicity, compactness and lower cost of the improved apparatus. The upper sensor 82 invariably prevents the excess in the respective compartment 81 from interfering with proper filling of the respective metering chamber 60, i.e., the upper level of excess liquid in a compartment 81 cannot rise to the level of the upper edge face of the respective duct 77 so that, once the chamber 60 is filled, the compartment 81 invariably provides room for reception of excess, i.e., of that quantity of liquid which overflows the open upper end of the duct 77. The sensors 82 further ensure that the collected excess does not dwell in the filling units 22 for relatively long intervals of time; such excess is returned into the body of liquid in the lower portion 3 of the distributor 2 as soon as the upper sensor 82 causes the control unit 39 to start the pump 41. This is desirable if the liquid contains ingredients (e.g., pulp) which tend to settle in the compartments 81.

The displacing members 79 can be replaced with other suitable means for regulating the volumes of the respective metering chambers 60. The illustrated plunger-like displacing members are preferred at this time because they need not be equipped with sealing means and need not be guided with a high degree of accuracy. Moreover, they can be raised and lowered without even partial dismantling of the apparatus.

An additional important feature of the improved apparatus is that at least some of its components can be of modular design to facilitate assembly, inspection, repair and replacement. Moreover, the modules can be assembled at the locus of use which is desirable and advantageous if such modules are to be assembled into a large apparatus which would take up a substantial amount of space in storage and/or during transport to a container filling plant. Moreover, even though the individual modules constitute or can constitute simple and inexpensive pieces of tubing, such modules can be assembled into a rigid apparatus which can stand pronounced stresses and can confine a large quantity of liquid. The modules 97, 97*a*, 97*b* and others can be connected to the rotor 8 in any suitable way, e.g., by welding or by riveting.

An advantage of the pipe 54 is that it can supply compressed gas from a stationary source 53 to a rotary part (upper portion 4 of the distributor 2) with minimal problems regarding prevention of leakage, even if the gas is maintained at an elevated pressure. The conveying of gas from the rotating upper portion 4 of the distributor 2 to the rotating vessel 24 presents no problems.

Still another advantage of the improved method and apparatus is that it is possible to fill containers with liquids of all kinds. The delivery of a liquid into the metering chambers 60 of the filling units 22 as well as the returning of excess from the compartments 81 of the filling units 22 to the lower portion 3 of the distributor 2 render it necessary to maintain the liquid in practically continuous motion which renders it possible to employ the apparatus for the filling of containers with liquids (e.g., beverages) which contain comminuted solid or other non-liquid substances (e.g., pulp), such as non-homogenized orange juice.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for admitting liquid into containers, particularly for admitting a pressurized carbonated beverage into bottles or cans, comprising a main source of supply of liquid including a rotary vessel and a distributor surrounded by the vessel, said distributor having at least one conduit which delivers liquid to said vessel; and container filling means comprising a plurality of filling units rotatable with said vessel and each including means for centering discrete containers for reception of liquid, a first sealable and openable outlet for admission of liquid into a centered container, a metering chamber for reception of a metered quantity of liquid into a centered container by way of a second sealable and openable outlet and for transfer of metered quantity of liquid into a centered container by way of said first outlet, and means for supplying from said source through said second outlet liquid in excess of that which is required to fill said metering chamber to capacity, said metering chamber comprising a portion from which the excess overflows.

2. The apparatus of claim 1, wherein each of said filling units further comprises means for collecting the excess.

3. The apparatus of claim 1, wherein each of said filling units further comprises a housing having a closed upper end and a lower end provided with said first outlet and said centering means.

4. The apparatus of claim 3, wherein said portion of each metering chamber includes an upright duct which is spacedly surrounded by the respective housing and receives liquid from said main source by way of the respective second outlet.

5. The apparatus of claim 4, wherein each of said ducts and the respective housing define a compartment for collection of the excess, each of said filling units further comprising means for evacuating excess from the respective compartment.

6. The apparatus of claim 1, further comprising means for returning the excess to said main source.

7. The apparatus of claim 1, wherein each of said filling units further comprises means for collecting the excess and further comprising a common conduit for evacuation of excess from the collecting means of said plurality of filling units and means for delivering excess from said common conduit to said main source.

8. The apparatus of claim 1, wherein the supply of liquid in said main source has a top surface which is maintained above a predetermined level, each of said metering chambers being located below said level.

9. The apparatus of claim 1, wherein each of said filling units includes a gas-containing upper portion which is located above the respective metering chamber and wherein the gas is maintained at a first pressure, said main source having a gas-filled upper part wherein the gas is maintained at a second pressure at least approximating said first pressure.

10. The apparatus of claim 1, further comprising means for regulating the capacity of each metering chamber.

11. The apparatus of claim 10, wherein each metering chamber has an open top and each filling unit has a gas-containing upper portion adjacent the open top of the respective chamber, each of said regulating means including a displacing member disposed in the respective upper portion and movable up and down through the open top of the respective metering chamber.

12. The apparatus of claim 1, further comprising means for at least reducing the rate of liquid flow through each second outlet and into the respective metering chamber once the metering chamber is filled to capacity.

13. Apparatus for admitting a liquid into containers, particularly for admitting a pressurized carbonated beverage into bottles or cans, comprising a main source of supply of liquid; and container filling means comprising at least one filling unit including means for centering discrete containers for reception of liquid, a first sealable and openable outlet for admission of liquid into a centered container, a metering chamber for reception of a metered quantity of liquid from said main source by way of a second sealable and openable outlet and for transfer of metered quantity of liquid into a centered container by way of said first outlet, means for supplying from said source through said second outlet liquid in excess of that required to fill said metering chamber to capacity, and means for returning the excess to said main source, said returning means comprising means for collecting the excess in said at least one filling unit, means for monitoring the collected excess, a pump operable to deliver excess from said collecting means to said main source, and control means for operating said pump when the quantity of monitored excess reaches a predetermined value.

14. Apparatus for admitting a liquid into containers, particularly for admitting a pressurized carbonated beverage into bottles or cans, comprising a main source of supply of liquid including a rotary vessel the vessel said distributor a distributor surrounded by and having at least one conduit which delivers liquid to said vessel; and container filling means comprising a plurality of filling units rotatable with said vessel and each of said filling units including means for centering discrete containers for reception of liquid, a first sealable and openable outlet for admission of liquid into a centered container, and a metering chamber for reception of a metered quantity of liquid from said main source by way of a second sealable and openable outlet and for transfer of metered quantity of liquid into a centered container by way of said first outlet, said main source comprising a plurality of arcuate modules each of which forms part of said vessel and is rotatable with at least two filling units, each of said modules comprising means for supplying liquid to the metering chambers of the respective units.

15. The apparatus of claim 14, wherein each of said modules further comprises a source of gaseous fluid and pipes connecting the source of gaseous fluid with the respective filling units.

16. The apparatus of claim 14, wherein each of said supplying means comprises conduits for supplying liquid to the metering chambers of the respective units in excess of that which is required to fill the metering chambers to capacity, and further comprising means for collecting the excess, said collecting means comprising an annular conduit having a plurality of arcuate sections each connected with and receiving excess liquid from at least two of said filling units.

17. The apparatus of claim 16, wherein each arcuate section of said collecting conduit is integrated into one of said modules.

18. The apparatus of claim 16, wherein each arcuate section of said collecting conduit has two closed ends.

19. The apparatus of claim 16, wherein each arcuate section of said collecting conduit includes a piece of tubing.

20. The apparatus of claim 14, further comprising a common driven rotor for said modules.

21. The apparatus of claim 14, wherein each of said modules has two closed ends.

22. The apparatus of claim 14, wherein each of said modules includes a piece of tubing.

23. Apparatus for admitting a liquid into containers, particularly for admitting a pressurized carbonated beverage into bottles or cans, comprising a main source of supply of liquid; and container filling means comprising a plurality of filling units each including means for centering discrete containers for reception of liquid, a first sealable and openable outlet for admission of liquid into a centered container and a metering chamber for reception of a metered quantity of liquid from said main source by way of a second sealable and openable outlet and for transfer of metered quantity of liquid into a centered container by way of said first outlet, said main source comprising an annular vessel rotatable with said units and a distributor surrounded by said annular vessel, said distributor including a liquid-containing stationary lower portion and a rotary upper portion connected with said annular vessel.

24. The apparatus of claim 23, further comprising a stationary source of gas, a pipe connected to said gas source and extending through said lower portion to admit gas into said upper portion, and at least one gas conveying pipe connecting said upper portion with said annular vessel to maintain in said annular vessel a supply of gas above a body of liquid.

* * * * *